United States Patent [19]

Burns

[11] 4,122,801

[45] Oct. 31, 1978

[54] WASTE ENERGY HOT WATER HEATER

[76] Inventor: Daniel E. Burns, 28 N. Main St., Canandaigua, N.Y. 14424

[21] Appl. No.: 785,654

[22] Filed: Apr. 25, 1977

[51] Int. Cl.[2] ..... F22D 1/02; F22B 31/02

[52] U.S. Cl. ..... 122/20 B; 122/421

[58] Field of Search ..... 122/20 A, 20 B, 250 R, 122/412, 421

[56] References Cited

U.S. PATENT DOCUMENTS

| | | | |
|---|---|---|---|
| 1,674,295 | 6/1928 | Perass | 122/20 |
| 2,395,035 | 2/1946 | Briggs | 122/250 |
| 2,429,663 | 10/1947 | Beatty | 122/20 |
| 3,793,992 | 2/1974 | Marquez | 122/20 |

*Primary Examiner*—Kenneth W. Sprague

[57] ABSTRACT

An attachment or, accessory water heater being installed in any furnace flue, or pipe giving off an exhaust heat. When installed in a flue or pipe and connected in conjunction to any type self-sufficient water heater tank. It is the purpose of this invention, to use the heat which escapes up the flue from the furnace during operation. Thus eliminating in most cases, and drastically reducing in others, the need for additional energy, which is normally used to heat water. The accessory heater is essentially a condensed unit, which divides water into multiple and smaller parts, comprising a conduit of two sizes, being formed and shaped into condensed spiral coils, and connected to rings or headers, and circulating water through the unit and back to the tank, by means of convection or pump.

2 Claims, 6 Drawing Figures

WASTE ENERGY HOT WATER HEATER

SUMMARY OF THE INVENTION

This unit is designed to efficiently use the energy wasted from the furnace exhaust heat which goes out the chimney. Instead of using the same size coil throughout the whole system as the feed and return, smaller coils are used inside the pipe to connect the feed to the return. The smaller diameter coils allow small quantities of water to be heated at one time, faster and more efficiently. The small coils also allow for a more condensed unit, proclaiming more efficiency. It is important though, to maintain at least the same volume of flow throughout the whole system as supplied by the feed.

DETAILED DESCRIPTION

Figure 6:
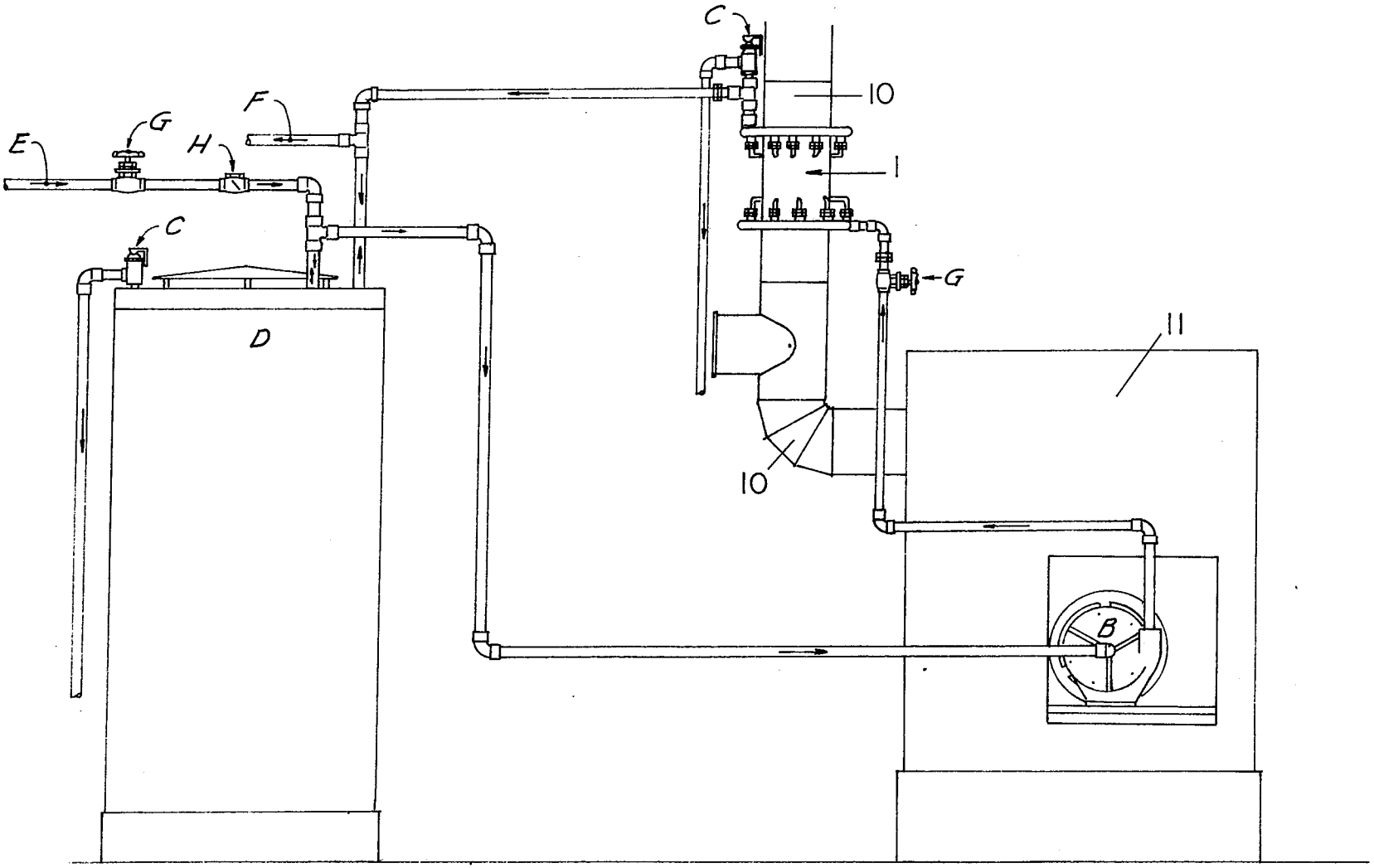
FIG. 6 shows unit installed in domestic type flue.

Before the invention description commences, it is to be understood that this invention being described herein in not to be limited to the construction details herein as it is highly obvious that the invention may be graduated or reduced in size with the need of hot water volumn, whether it be more or less, also it is not meant to hold limitations to the positioning and arrangement of the invention as employed in FIG. 6.

Figure 1:
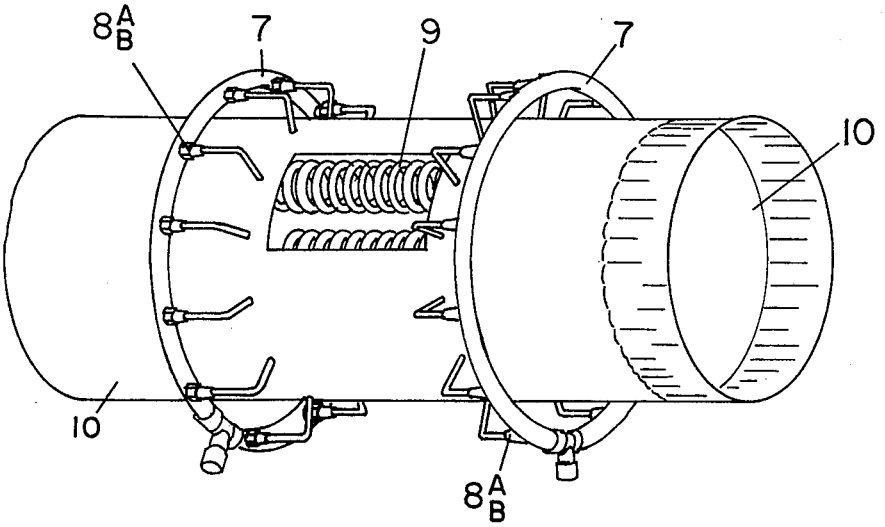
FIG. 1 is a plain view of completed unit.
Figure 2:
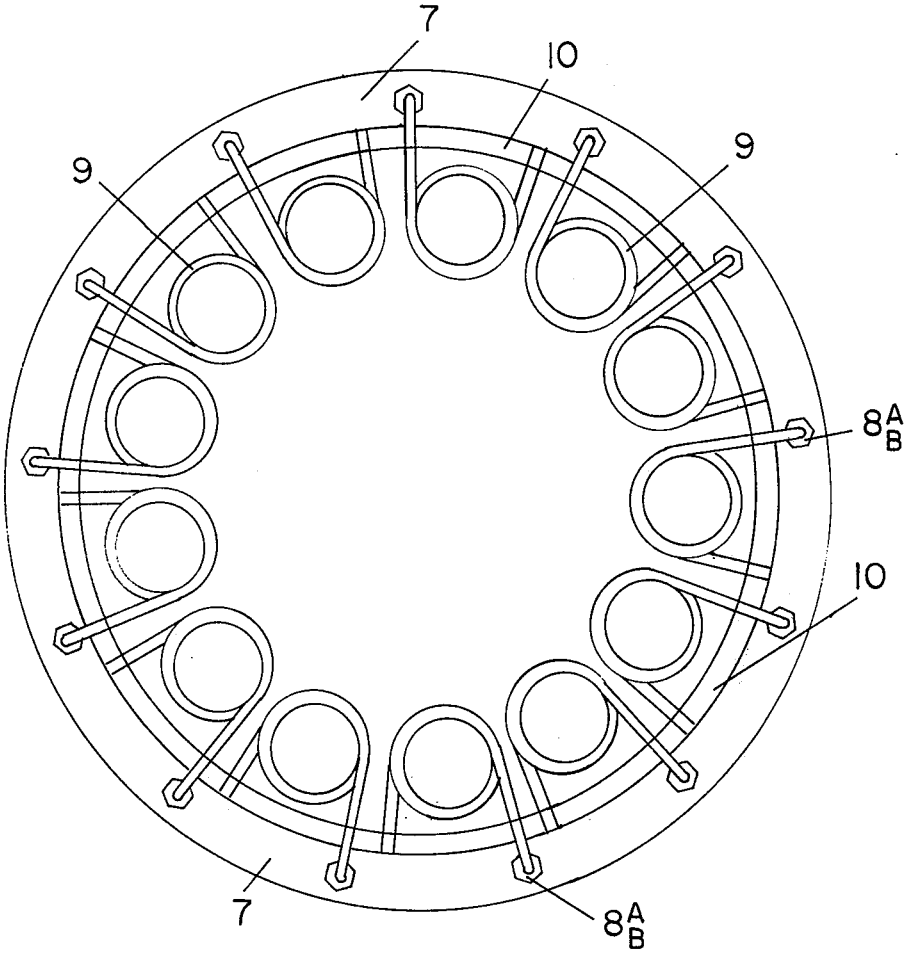
FIG. 2 shows an end view, looking straight through end of flue pipe.
Figure 3:
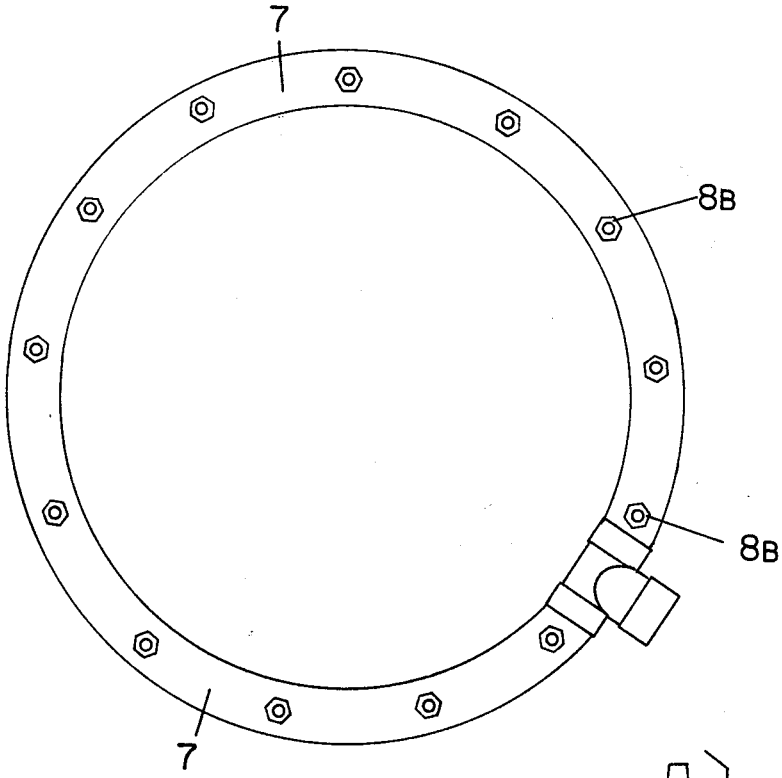
FIG. 3 shows rings assembled with flare adaptors.
Figure 5:
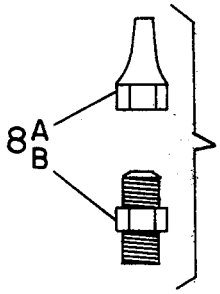
FIG. 5 shows flare adaptor and nut.
Figure 4:
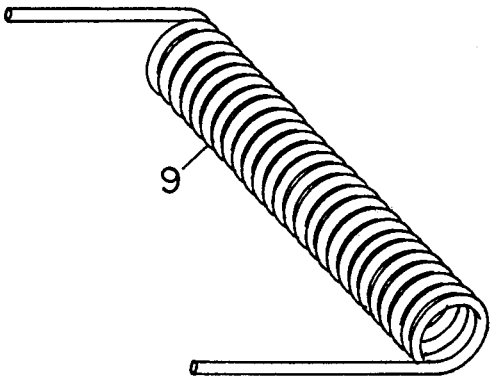
FIG. 4 shows completed coil.

FIG. 1. Is a completed view of the invention which shows a cutaway window with coils 9 positioned to the inside of flue 10 and coils 9 protruding through to the outside of flue 10. Flare nuts and adaptors 8 A–B joining together coils 9 to conduit ring or header 7. FIG. 2 showing an open end view of flue 10 with coils 9 positioned to the inside perimeter of the flue 10 and coils 9 protruding through to the outside of flue 10. FIG. 3 shows conduit formed into header or ring 7 with flare adaptor 8 B. FIG. 4 shows conduit shaped into a spiral coil 9 which is approximately eight times smaller in size than conduit use for header ring 7. FIG. 5 show flare nut 8 A. and flare adaptor 8 B. FIG. 6 shows inlet water suply E to gate valve G to one way valve H to tank D. Following arrows to pump B and on to gate valve G through invention 1 back to tank D and to outlet line F to various taps. Pressure safty valve C is on tank D safty valve C is also found at top of invention 1.

I claim:

1. An accessory water heater for use in an exhaust flue of a heating device;

said accessory water comprising an inlet conduit externally around the exhaust flue, an outlet conduit disposed externally around the exhaust flue and spaced along the length of the flue from said inlet conduit, a plurality of small coils positioned around the inner periphery of the exhaust flue, each of said coils having inlet means and outlet means extending through the exhaust flue, means connecting said inlet means of each coil to said inlet conduit and means connecting said outlet means of each coil to said outlet conduit.

2. An accessory unit according to claim 1, wherein said connecting means comprises a detachable coupling means.

* * * * *